US007878350B2

(12) United States Patent
Ramoundos

(10) Patent No.: US 7,878,350 B2
(45) Date of Patent: Feb. 1, 2011

(54) PILL BOTTLE WITH INDICATOR DEVICE

(75) Inventor: Nicholas H. Ramoundos, New York, NY (US)

(73) Assignee: The Rock Link, Inc., New York, NY (US)

( * ) Notice: Subject to any disclaimer, the term of this patent is extended or adjusted under 35 U.S.C. 154(b) by 509 days.

(21) Appl. No.: 11/606,473

(22) Filed: Nov. 30, 2006

(65) Prior Publication Data

US 2008/0128381 A1 Jun. 5, 2008

(51) Int. Cl.
*B65D 51/00* (2006.01)
*G09F 3/00* (2006.01)
*G09F 9/00* (2006.01)

(52) U.S. Cl. ..... 215/230; 40/311; 116/308; 116/309

(58) Field of Classification Search ..... 215/230, 215/217, 396–400; 116/308, 309, 311; 206/534, 206/459.1; 40/311
See application file for complete search history.

(56) References Cited

U.S. PATENT DOCUMENTS 1,868,903 A * 7/1932 Jennings ..... 40/495
2,024,889 A * 12/1935 Simeone ..... 116/311
2,936,089 A * 5/1960 Goldfarb et al. ..... 215/6
3,151,599 A 10/1964 Livingston
3,572,282 A 3/1971 Tump et al.
3,903,837 A 9/1975 Barton et al.
3,904,075 A * 9/1975 Richardson et al. ..... 221/5
3,960,713 A * 6/1976 Carey ..... 206/534
4,011,829 A 3/1977 Wachsmann et al.
4,220,247 A 9/1980 Kramer
4,365,722 A * 12/1982 Kramer ..... 215/220
4,432,300 A 2/1984 Lyss
4,489,834 A 12/1984 Thackrey
4,528,933 A * 7/1985 Allen ..... 116/308
4,666,051 A * 5/1987 Trick ..... 215/230
4,749,093 A 6/1988 Trick
4,753,189 A 6/1988 Mastman et al.
4,756,423 A * 7/1988 Holtsch ..... 206/534
4,913,083 A 4/1990 Valvo et al.
4,915,256 A 4/1990 Tump
4,920,912 A * 5/1990 Kirkling ..... 116/308
5,046,605 A * 9/1991 Levrant ..... 206/5.1
5,082,129 A * 1/1992 Kramer ..... 215/221
5,184,739 A 2/1993 Kusz
5,299,701 A * 4/1994 Barker et al. ..... 215/230
5,313,439 A 5/1994 Albeck (Continued)

*Primary Examiner*—Anthony Stashick
*Assistant Examiner*—Brett Edwards
(74) *Attorney, Agent, or Firm*—Greenberg Traurig, LLP

(57) ABSTRACT

A medication bottle includes a container and a closure removably fastened thereto. The closure includes a dial having an exterior surface with a series of indicia imprinted thereon, and an interior surface having a handle that protrudes therefrom. Each indicia represents a time increment at which a next pill dosage is required to be taken by a user. The exterior surface of the closure includes a window that exposes a particular indicia. Upon removing the closure from the container, the user can rotate the dial via the handle in order to expose in the window the next time increment a dose is required to be consumed. The dial can only be rotated after the closure is removed from the pill container. Upon replacing the closure onto the container, the selected indicator remains immovable and represents an accurate reminder for the next time a dose is required to be taken.

15 Claims, 5 Drawing Sheets

U.S. PATENT DOCUMENTS 5,377,614 A 1/1995 Glazer
5,520,307 A * 5/1996 Miller et al. ..... 221/2
5,577,335 A 11/1996 Tucker
5,579,934 A 12/1996 Buono
5,638,970 A 6/1997 Garby et al.
5,662,224 A 9/1997 Nogues
5,678,712 A 10/1997 Rios
5,732,836 A * 3/1998 Barker et al. ..... 215/230
5,765,706 A 6/1998 Barker et al.
5,806,707 A * 9/1998 Boehm et al. ..... 220/522
5,823,346 A * 10/1998 Weiner ..... 206/534
5,979,698 A 11/1999 Deal
5,984,122 A 11/1999 Barker et al.
6,003,467 A 12/1999 Shelton-Ferrell et al.
6,032,609 A 3/2000 Luoma
6,059,133 A * 5/2000 Lai ..... 215/230
6,089,180 A * 7/2000 Nichols, Jr. ..... 116/309
6,311,840 B1 * 11/2001 Shrader ..... 206/459.1
6,779,480 B2 8/2004 Zamjahn
6,789,497 B1 9/2004 Aiken
6,802,279 B1 10/2004 Johnson
7,017,762 B2 * 3/2006 Shane ..... 215/230
7,147,127 B2 * 12/2006 Lepke et al. ..... 221/4
7,222,736 B1 * 5/2007 Seijas ..... 206/534
7,556,151 B2 * 7/2009 Seijas ..... 206/534
7,621,231 B2 * 11/2009 McNeely ..... 116/308
7,637,227 B2 * 12/2009 Stradella et al. ..... 116/307
2002/0190022 A1 * 12/2002 Pitassi ..... 215/321
2006/0124501 A1 * 6/2006 McNeely ..... 206/534

* cited by examiner

PILL BOTTLE WITH INDICATOR DEVICE

FIELD OF THE INVENTION

The present invention relates to closures for pill bottles, and more particularly, to closures for pill bottles that include indicator devices for keeping track of medication schedules.

BACKGROUND OF THE INVENTION

There exists a number of pill bottle closures having indicators, such as dials, that enable a user to keep track of his medication schedule (e.g., the day and/or time of day when the user must take his next medication dosage). Some of these closures employ mechanisms, such as ratcheting teeth, that automatically rotate the dials upon the removal of the closures from the containers, or upon replacement of the closures onto the containers, so as to display new indications of the next dosage period. Other closures employ dials that are manually rotated by a user.

The problem with these existing closures is that the dials may be inadvertently rotated, which would result in false indications of the next time period a user must take his medication. For instance, if a user removes the closure from, or fastens the closure to, the bottle without intending to rotate the indicator dial, then the dial would display an inaccurate reading. Likewise, manually moveable indicator dials can be inadvertently rotated, regardless of whether the cap is affixed to, or unfastened from, the bottle (for instance, when the bottle is in a user's pocket, luggage, etc). Therefore, what is needed, but has yet to be provided, is a pill bottle closure that employs an indicator dial which, once the indication of the dial is properly set and the closure attached to the bottle, is not subject to inadvertent rotation.

SUMMARY OF THE INVENTION

The problems and disadvantages associated with the prior art are overcome by the present invention, which includes a pill bottle having a container and a closure that is removably fastened to the container. The closure includes a dial that is rotatably housed therein. The dial includes an upper surface having a series of indicia imprinted thereon (e.g., days of the week, times, etc.) and a lower surface having a handle that protrudes outwardly therefrom. Each indicator represents a time period, such as a day and/or a time of day, at which time a next pill dosage is required to be taken by the user. The outer surface of the closure includes a window that is sized and shaped to expose a particular indicator.

Upon removing the closure from the container, the user can rotate the dial via the handle in order to expose in the window the next day and/or time of day a dose is required to be consumed. The dial can only be rotated after the closure is removed from the pill container. Upon replacing the closure onto the container, the selected indicator (which is visible through the window) remains immovable and represents an accurate reminder for the next time a dose is required to be taken.

Specifically, the present invention has been adapted for use in connection with pill bottles. However, the present invention can be adapted for use in connection with other types of bottles or dispensers, such as liquid medication bottles, vitamin bottles, and other food and beverage containers.

BRIEF DESCRIPTION OF THE DRAWINGS

For a better understanding of the present invention, reference is made to the following detailed description of an exemplary embodiment considered in conjunction with the accompanying drawings, in which.

DETAILED DESCRIPTION OF THE INVENTION

Figure 1:
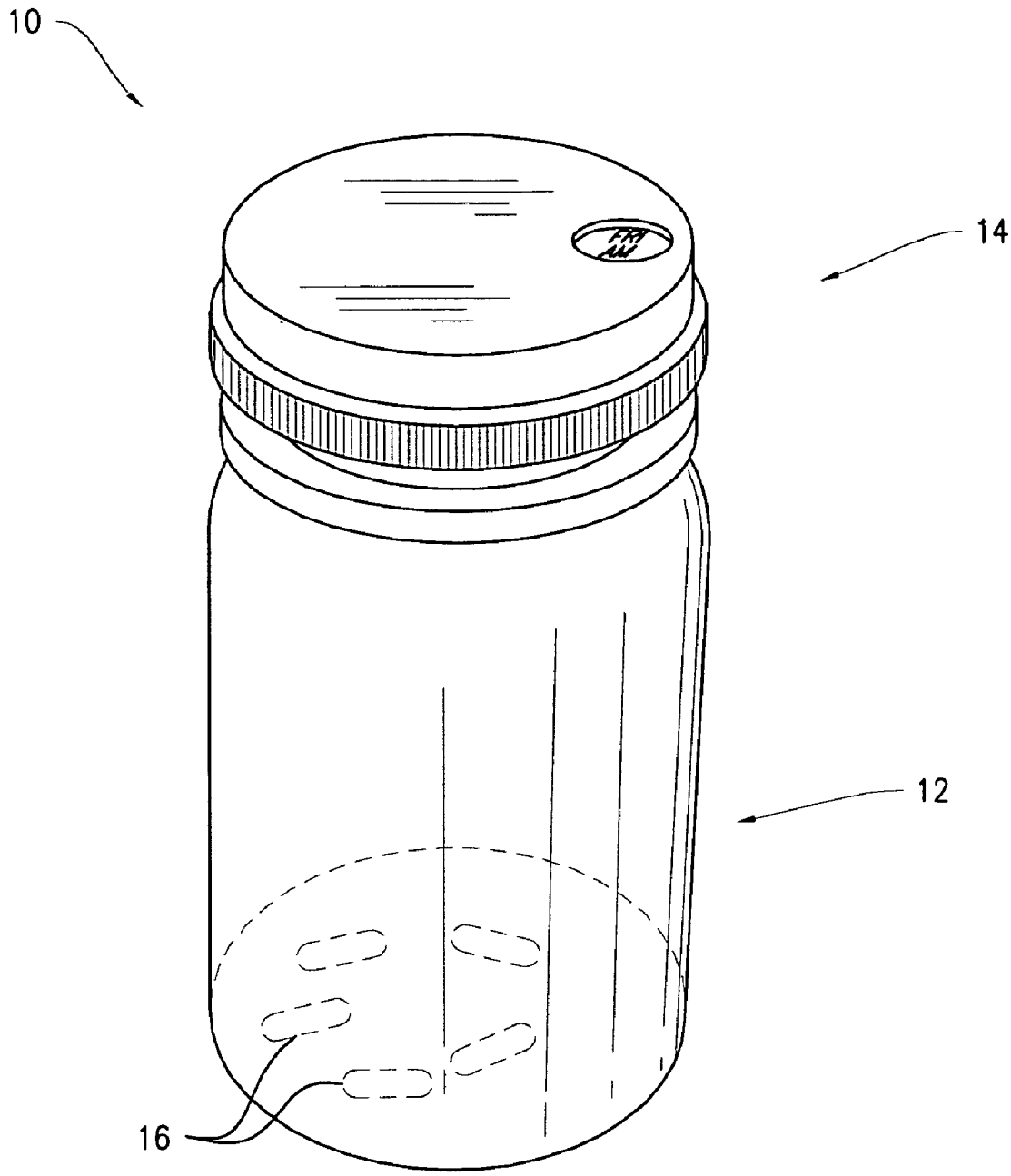
FIG. 1 is a perspective view of a pill bottle constructed in accordance with an exemplary embodiment of the present invention.

Referring to FIG. 1, a pill bottle 10 includes a cylindrical-shaped container 12 and a disc-shaped closure 14 that is sized and shaped to be removably attached to the container 12. The container 12 is adapted to receive a plurality of pills 16, such as capsules or tablets. However, the container 12 may be adapted to receive other forms of medication, such as liquid medication, or it can be adapted to receive other items, such as vitamins or food and beverage products.

Figure 2:
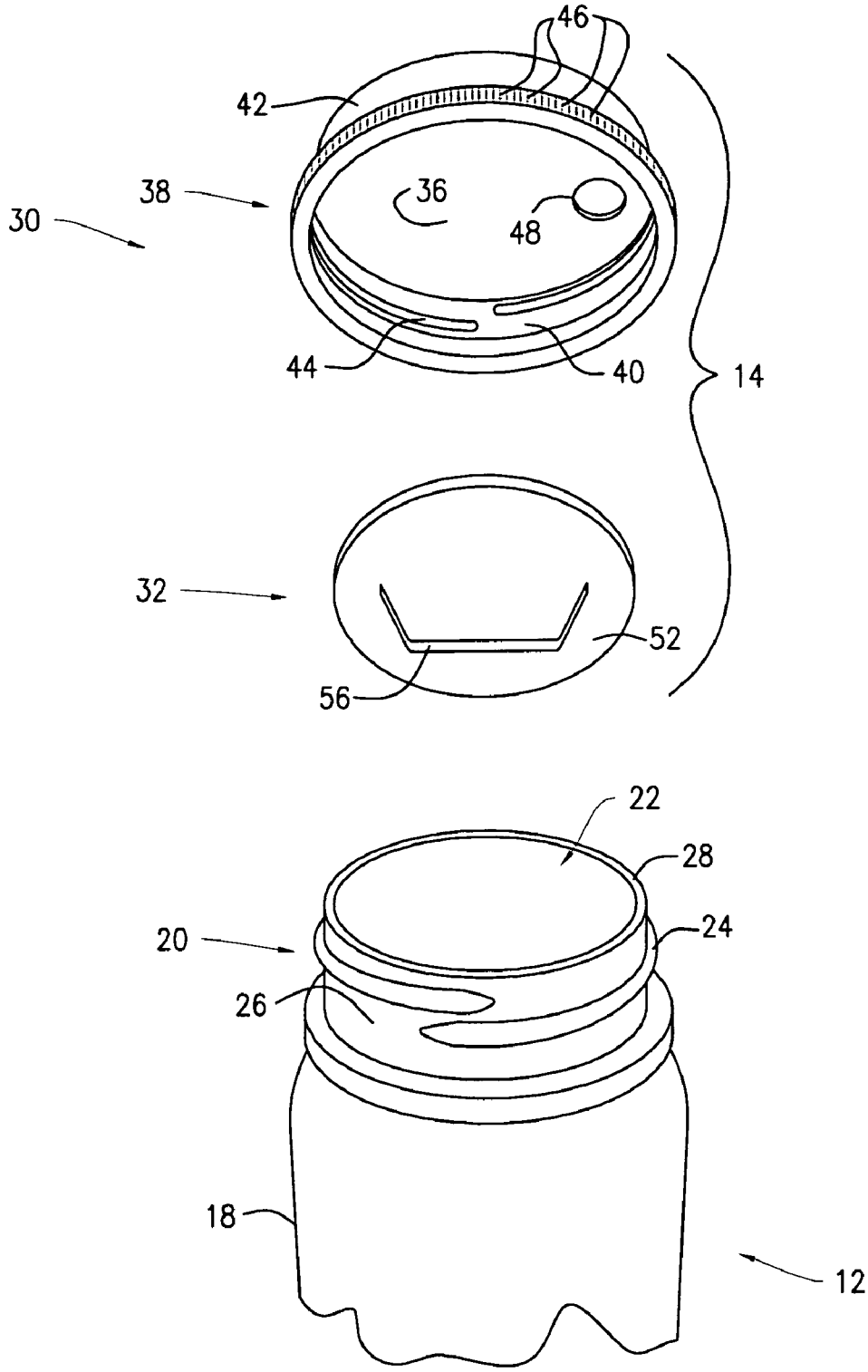
FIG. 2 is an exploded perspective view of the pill bottle shown in FIG. 1.

Referring to FIG. 2, the container 12 includes a cylindrical-shaped body 18 having a neck 20 formed at an upper end 21 thereof. The neck 20 includes a circular-shaped opening 22 through which the pills 16 are placed into and removed from the container 12. The neck 20 further includes a plurality of threads 24 formed on an exterior surface 26 thereof and a flat, circular-shaped edge 28 that circumferentially surrounds the opening 22.

Figure 3:
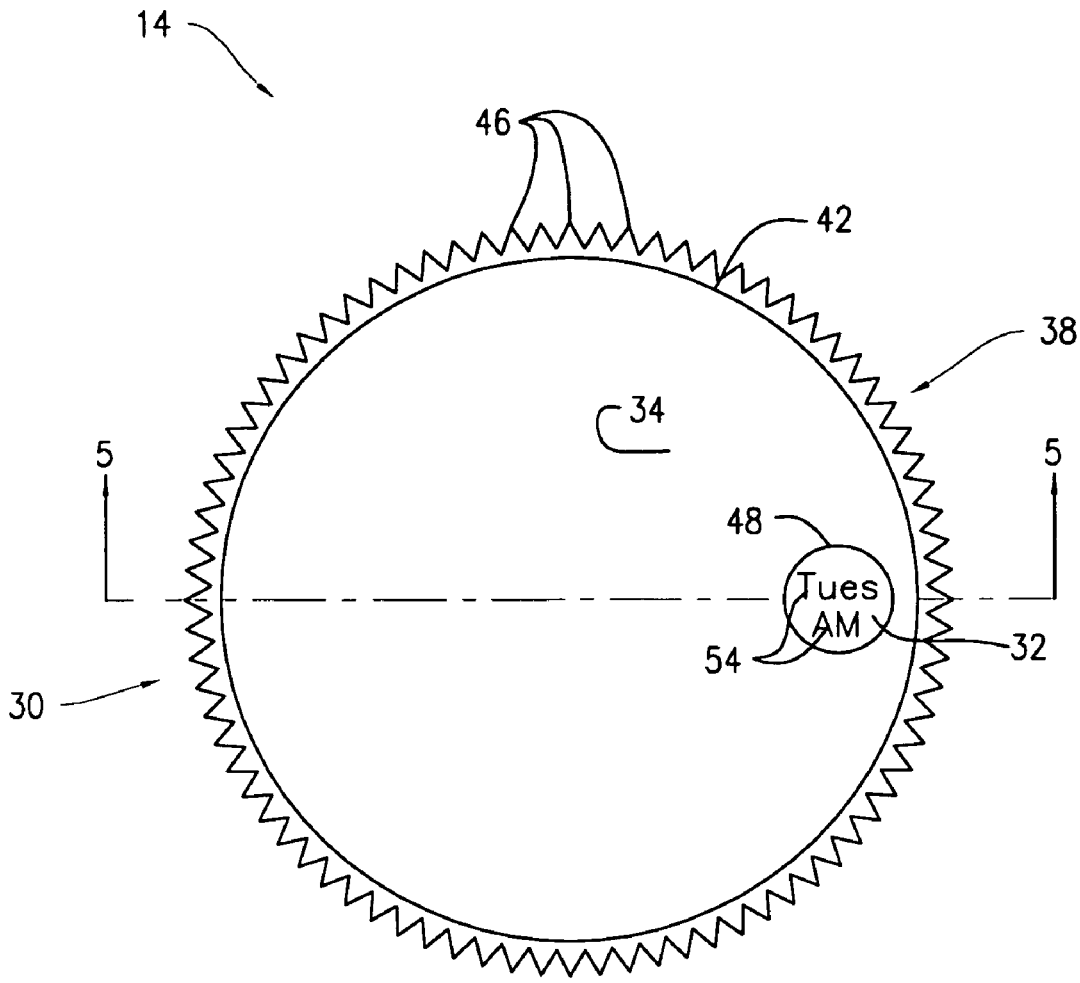
FIG. 3 is a top elevational view of the pill bottle shown in FIG. 1.

Referring now to FIGS. 2 and 3, the closure 14 includes a cap 30 and a disc-shaped dial 32 that is housed rotatably within the closure 14 in a manner which will be described in greater detail hereinafter. The cap 30 includes an upper surface 34 and a lower surface 36, and a cylindrical-shaped skirt 38 having an interior surface 40 with a diameter D1 and an exterior surface 42. A plurality of threads 44 are disposed on the interior surface 40 of the skirt 38, and are sized and shaped to threadedly engage the threads 24 of the container 12 so that the closure 14 may be removably affixed thereto. The exterior surface 42 of the skirt 38 includes knurling 46, whose function shall be described hereinafter.

Still referring to FIGS. 2 and 3, the cap 30 further includes a circular-shaped window 48 that extends from the upper surface 34 to the lower surface 36 thereof. Preferably, the cap 30 includes the window 48, but it may include more than one window. The function of the window 48 shall be described hereinafter.

Figure 4:
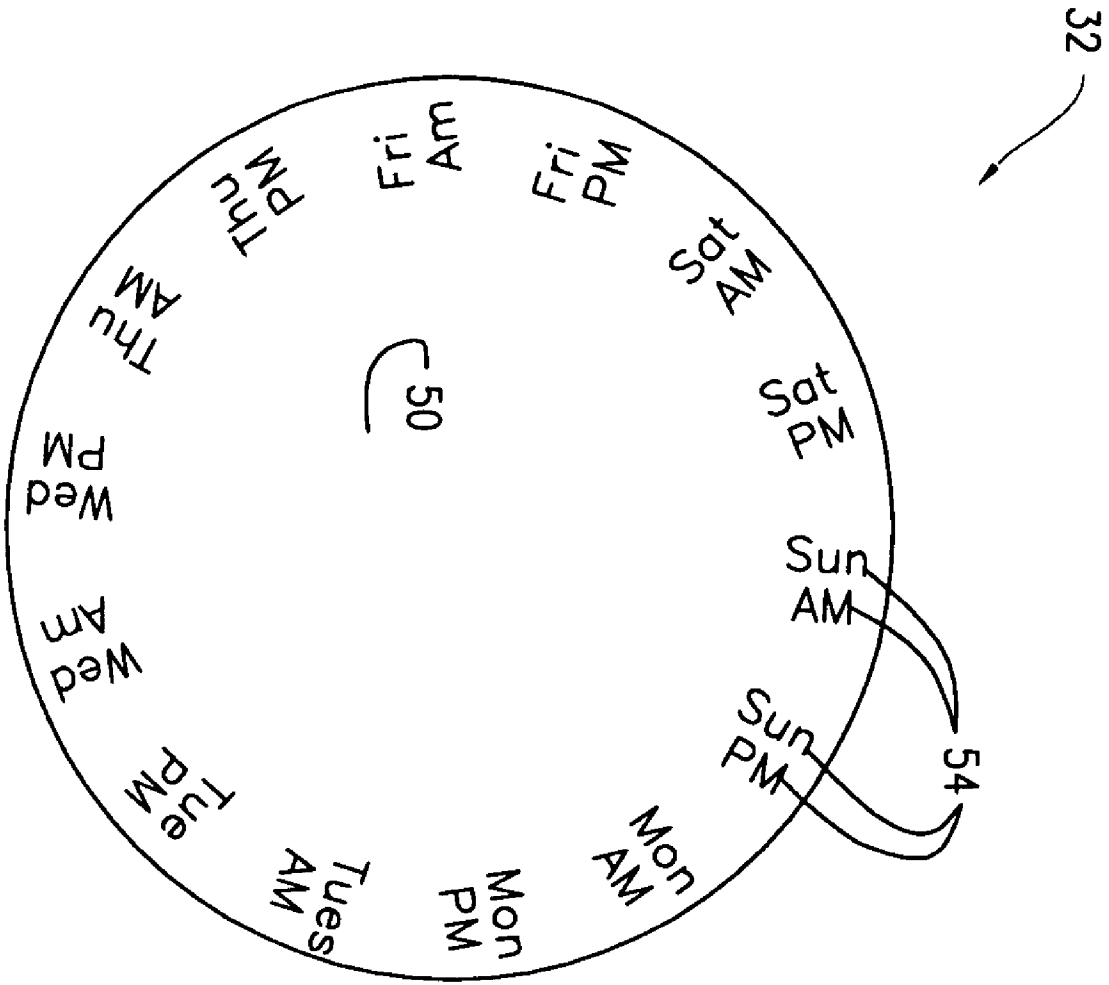
FIG. 4 is a top elevational view of a dial employed by the pill bottle shown in FIG. 3.
Figure 5:
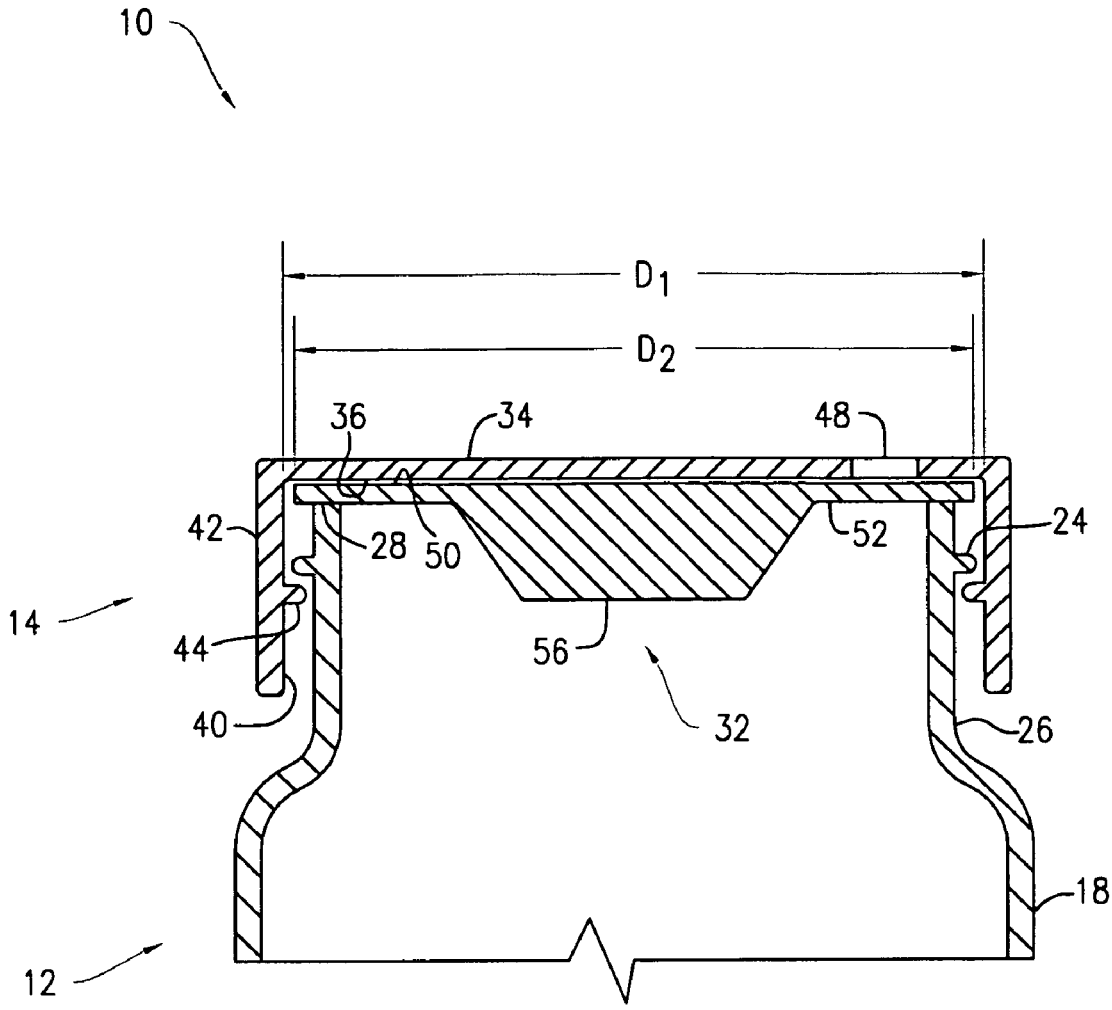
FIG. 5 is a cross sectional view, taken along section line 5-5 and looking in the direction of the arrows, of the pill bottle shown in FIG. 3.

Referring now to FIGS. 4 and 5, the dial 32 includes an upper surface 50 and a lower surface 52, and has a diameter D2 (not shown in FIG. 4, but see FIG. 5). The upper surface 50 of the dial 32 includes indicia 54, while a handle 56 protrudes outwardly from the lower surface 52 of the dial 32 (not shown in FIG. 4, but see FIG. 5). The diameter D1 of the skirt 38 is only slightly larger than the diameter D2 of the dial 32; and, therefore, the dial 32 is free to rotate. In addition, the threads 40 outwardly extend far enough in order to prevent the dial 32 from disengaging from the cap 30.

Many types of indicia 54 may be utilized. These include, but are not limited to, time of day (e.g., 8:00 AM, 4:00 PM, etc.); day of the week (e.g., Sunday, Monday, etc.); and number of pills (e.g., 1 pill, 2 pills).

Preferably, the container 12 and the cap 30 are fabricated from plastic (e.g., by injection molding), but they may be made with other materials known in the art. The container 12 may be clear or opaque. The dial 32 is also, preferably, fabricated from plastic, but it can be made from other materials.

Preferably, the body 18 of the container 12 is cylindrical in shape, but it may consist of other shapes and sizes. Preferably, the window 48 is circular in shape, but it may consist of other shapes and sizes, (e.g., square, rectangular, elliptical, triangular, etc.).

Use of the pill bottle 10 is accomplished in the following manner. Aided by the knurling 46, a user twists off the closure 14 from the container 12 for access to the pills 16. The user may then set the dial 32 to indicate the next time he must take his next dosage of medication. More particularly, the dial 32 is rotated by grasping the handle 56 in order to expose in the window 48 the desired indicia 54 (e.g., the next day and/or time of day) when a next dose is required to be consumed. The closure 14 is then placed back onto the neck 20 of the container 12 such that the closure 14 is threadedly engaged with the container 12. In this position, the dial 32 is wedged between the edge 28 of the container and the lower surface 36 of the cap 30. As a result, the dial 32 is prohibited from rotating relative to the cap 30; and, therefore, the correct indicia 54 will be viewed through the window 48. In addition, the handle 56 of the dial 32 is inaccessible to the user when the closure 14 is engaged with the container 12. Thus, the dial can only be rotated manually after the closure is removed from the pill container. As a result, the user cannot inadvertently turn the dial 32 in a manner that would result in the wrong indicia 54 being viewed through the window. Consequently, the indicia 54 represents an accurate reminder for the next time a dose is required to be taken.

It should be understood that the embodiment described herein is merely exemplary and that a person skilled in the art may make many variations and modifications without departing from the spirit and scope of the invention. For example, more than one set of indicia 54 may be imprinted on the dial 32 so as to be simultaneously displayed in more than one window of the cap 30 (e.g., a first window showing a day and time indication, and a second window showing a dosage indication). The size and shape of the handle of the dial may be varied (e.g., ball-shaped, pin-shaped), or the handle may be replaced with a sandpaper-like coating applied to the lower surface of the dial. Alternately, the dial may be provided without a handle. The threads 44 of the cap 30 and the threads 24 of the container 12 may be replaced with alternative means for fastening the closure 14 to the container 12 (e.g., clips, clasps, tabs and tab locks, etc.). All such variations and modifications are intended to be included within the scope of the invention as defined in the appended claims.

I claim:

1. A medication bottle, comprising a container having an open end, a closed end opposite said open end and an interior portion between said open and closed ends; and a closure releasably attached to said open end of said container, said closure including a cap having an exterior surface, which covers said open end of said container, an interior surface opposite said exterior surface, a peripheral edge, a skirt extending along said peripheral edge and projecting in a first direction towards said closed end of said container when said closure is attached to said open end of said container, and a dial having a first surface and a second surface opposite said first surface, said dial being rotatably mounted to said cap such that said first surface of said dial is juxtaposed with said interior surface of said cap, said first surface of said dial including a plurality of indicia that represent selected points of time to dispense a dosage of medication, said plurality of indicia being sequentially visible through said exterior surface of said cap, said dial having an, elongated, fin-like handle formed from said second surface thereof in said first direction, said handle being engageable by a human operator when said closure is removed from said container in order to select one of said plurality of indicia by manually rotating said dial in response to the rotation of said handle, said handle being surrounded by said skirt so as to inhibit said handle and hence said dial from being inadvertently rotated by an object located externally of said closure when said closure is removed from said container, and said handle being positioned within said interior portion of said container and projecting towards said closed end of said container when said closure is attached to said container so as to prevent said handle and hence said dial from being inadvertently rotated by an object located externally of the medication bottle.

2. The medication bottle as claimed in claim 1, wherein said exterior surface of said cap includes a window for displaying one of said plurality of indicia of said dial.

3. The medication bottle as claimed in claim 2, wherein said closure is attached to said container by at least one snap tab.

4. The medication bottle as claimed in claim 2, wherein said closure is threadedly attached to said container.

5. The medication bottle as claimed in claim 4, wherein said plurality of indicia includes a day of a week.

6. The medication bottle as claimed in claim 4, wherein said plurality of indicia includes a time of day.

7. The medication bottle as claimed in claim 4, wherein said plurality of indicia includes a number for indicating a dosage amount.

8. The medication bottle as claimed in claim 4, wherein said container is adapted to receive a plurality of pills.

9. The medication bottle as claimed in claim 4, wherein said container is adapted to receive liquid medication.

10. The medication bottle as claimed in claim 1, wherein said dial is wedged between said interior surface of said cap and said open end of said container when said closure is attached to said container so as to inhibit rotation of said dial relative to said cap.

11. The medication bottle as claimed in claim 1, wherein said closure is sized and shaped to be complimentary to the size and shape of said dial.

12. The medication bottle as claimed in claim 11, wherein said closure is circular in shape.

13. A medication bottle, comprising a container having an open end defined by an outer edge, a closed end opposite said open end, external threads located proximate to said open end of said container, and an interior portion between said open and closed ends; and a closure releasably attached to said open end of said container, said closure including a cap having an exterior surface, which covers said open end of said container, an interior surface opposite said exterior surface, a peripheral edge, a skirt extending along said peripheral edge and projecting from said interior surface in a first direction towards said closed end of said container when said closure is attached to said open end of said container, and internal threads threadedly engageable with said external threads of said container so as to removably attach said closure to said container, and a dial having a first surface and a second surface opposite said first surface, said dial being mounted to said cap such that said dial is rotatable relative to said cap and said dial is movable in said first direction between said interior surface of said cap and said internal threads of said cap, said dial including an outer rim positioned proximate to said skirt and between said interior surface of said cap and said internal threads of said cap in order to prevent said dial from disengaging said cap when said closure is removed from said container, said dial extending radially a distance sufficient to allow said outer rim thereof to overhang said outer edge of said container, said first surface of said dial including a plurality of indicia that represent selected points of time to dispense a dosage of medication, said plurality of indicia being sequentially visible through said exterior surface of said cap, said dial having a handle projecting directly from said second surface thereof in said first direction, said handle being engageable by a human operator when said closure is removed from said container in order to select one of said plurality of indicia by manually freely rotating said dial in response to the rotation of said handle, said handle being surrounded by said skirt so as to inhibit said handle and hence said dial from being inadvertently rotated by an object located externally of said closure when said closure is removed from said container, and said handle being positioned within said interior portion of said container and projecting towards said closed end of said container when said closure is attached to said container so as to prevent said handle and hence said dial from being inadvertently rotated by an object located externally of the medication bottle, said first surface of said dial being in direct contact with said interior surface of said cap and said second surface of said dial being in direct contact with said outer edge of said container when said closure is attached to said container, thereby wedging said dial between said container and said closure so as to inhibit rotation of said dial.

14. The medication bottle as claimed in claim 13, wherein said dial is rotatable in either a clockwise direction or a counterclockwise direction when said closure is removed from said container.

15. The medication bottle as claimed in claim 14, wherein said dial is inhibited from rotating relative to said cap in either a clockwise direction or a counterclockwise direction when said closure is attached to said container.

* * * * *